US007866096B2

(12) United States Patent
Lee et al.

(10) Patent No.: US 7,866,096 B2
(45) Date of Patent: Jan. 11, 2011

(54) SLOPE COMPENSATOR FOR PEDESTAL FOR ELEVATED FLOORS

(75) Inventors: Alan Sian Ghee Lee, 21 Almond Crescent, Singapore, 677779 (SG); Henry Greaves, Queens Park (AU)

(73) Assignee: Alan Sian Ghee Lee, Singapore (SG)

( * ) Notice: Subject to any disclaimer, the term of this patent is extended or adjusted under 35 U.S.C. 154(b) by 364 days.

(21) Appl. No.: 12/109,233

(22) Filed: Apr. 24, 2008

(65) Prior Publication Data

US 2008/0222973 A1 Sep. 18, 2008

Related U.S. Application Data

(63) Continuation-in-part of application No. PCT/AU2006/001613, filed on Oct. 27, 2006.

(30) Foreign Application Priority Data

Oct. 28, 2005 (AU) ..... 2005905990

(51) Int. Cl.
*E04F 15/024* (2006.01)

(52) U.S. Cl. ..... 52/126.6; 52/126.1; 52/302.5; 52/105; 52/263; 248/351

(58) Field of Classification Search ..... 52/126.6, 52/126.5, 126.1, 126.7, 263, 303.1, 302.5, 52/105; 248/188.2, 188.4, 351, 357, 346.1, 248/346.06, 133; 108/150
See application file for complete search history.

(56) References Cited

U.S. PATENT DOCUMENTS 3,318,057 A * 5/1967 Norsworthy ..... 52/126.6
3,398,933 A * 8/1968 Haroldson ..... 52/126.6
4,558,544 A * 12/1985 Albrecht et al. ..... 52/126.6
4,982,539 A * 1/1991 Hiller ..... 52/263

(Continued)

FOREIGN PATENT DOCUMENTS

DE 37 09 017 10/1988

(Continued)

OTHER PUBLICATIONS

PCT Written Opinion of the International Searching Authority and International Search Report, International Application No. PCT/AU2006/001613, Australian Patent Office, Jan. 23, 2007, 12 pages.

(Continued)

*Primary Examiner*—Robert J Canfield
*Assistant Examiner*—Jessie Fonseca

(57) ABSTRACT

A slope adjustable head for an adjustable pedestal (10) for supporting beams, panel members, typically pavers, in accurate edge aligned relation, in a level plane is disclosed. The pedestal (10) includes a base block (12) and a series of inter-engaging threaded annular elements (20, 30) which can be rotated relative to each other to adjust the height of the top of the pedestal in a screw jack fashion. A slope compensator is located at the top of the pedestal and comprises a slope compensation plate (100) and a head member (50). Rotation of the slope compensation plate (100) about its center of curvature causes the angle of the adjustment plate relative to the vertical axis to change thus allowing for compensation for the slope of the surface on which the pedestal is standing.

20 Claims, 16 Drawing Sheets

U.S. PATENT DOCUMENTS

| | | | | | |
|---|---|---|---|---|---|
| 5,333,423 | A * | 8/1994 | Propst | ..... | 52/126.6 |
| 5,588,264 | A * | 12/1996 | Buzon | ..... | 52/126.6 |
| 6,155,015 | A * | 12/2000 | Kirby | ..... | 52/302.1 |
| 6,332,292 | B1 | 12/2001 | Buzon | | |
| 6,363,685 | B1 * | 4/2002 | Kugler | ..... | 52/745.05 |
| 2003/0070372 | A1 * | 4/2003 | Favero | ..... | 52/220.1 |

FOREIGN PATENT DOCUMENTS

| | | |
|---|---|---|
| EP | 0 309 399 | 3/1989 |
| EP | 1 304 426 | 4/2003 |
| GB | 985148 | 3/1965 |
| GB | 2317903 | 4/1998 |

OTHER PUBLICATIONS

Supplementary European Search Report dated Feb. 12, 2010 for European Application No. 06 79 0440; 8 pages.

* cited by examiner

SLOPE COMPENSATOR FOR PEDESTAL FOR ELEVATED FLOORS

CROSS-REFERENCE TO RELATED APPLICATIONS

The present application is a continuation-in-part of PCT/AU2006/001613 which claims priority from Australian Provisional Patent Application No 2005905990 filed on 28 Oct. 2005, the contents of both applications being incorporated herein by reference.

FIELD OF THE INVENTION

This invention relates to a slope compensator for a pedestal for elevated floors.

BACKGROUND OF THE INVENTION

It is known to provide elevated or raised floors, also known as pedestal floors. Elevated flooring incorporates a number of height adjustable pedestals which are uniformly distributed over a subsurface/sub floor such as a concrete floor of a multi-story building, a roof, terrace, or any other surface on top of which it is desired to locate an elevated floor. Other non-exhaustive applications of pedestal floors include technical floors for laboratories, fitting out old buildings, patios, balconies, swimming pool surrounds and decking. The pedestals cooperate in supporting floor panels, such as pavers, or other floor surfaces. The panel members provide a relatively flat high strength floor.

Problems arise when forming a raised surface on a sub floor/subsurface which is not itself horizontal such as roof terrace which will typically slope at an angle of up to 5% in order to allow water run off.

Although height adjustable pedestals with means for compensating for slope, are known to address the problem of slope, existing pedestals incorporating slope adjustment tend to be rather awkward to use and adjust. One common problem with existing systems is that where slope compensation is provided, it may not always be immediately apparent which direction the head of the pedestal should face, relative to the slope of the subsurface.

One further problem with existing pedestal jacks is stability of the pedestals and this is a problem which is currently and somewhat unsatisfactorily addressed by tying wire to the pedestals which is awkward messy and does not work well.

Any discussion of documents, acts, materials, devices, articles or the like which has been included in the present specification is solely for the purpose of providing a context for the present invention. It is not to be taken as an admission that any or all of these matters form part of the prior art base or were common general knowledge in the field relevant to the present invention as it existed before the priority date of each claim of this application.

SUMMARY OF THE INVENTION

According to the present invention, there is provided an adjustable pedestal adapted to support panel members of an elevated floor structure comprising:

a height adjustable support structure including a base and a head assembly, the base defining a plane on which the support structure stands in use, said head assembly including:

a head member; and a slope adjustment plate, wherein the head member defines a first part-spherical, typically concave, surface having a first radius of curvature, and the slope adjustment plate has a first face defining a planar area and an opposite face defining a second part-spherical, typically convex, surface having substantially the same radius of curvature as the first surface, and wherein the part spherical convex surface may be supported on the part spherical concave surface, with relative movement of the convex surface on the concave surface adjusting the angle of the planar portion of the adjustment plate relative to the plane of the base, the head member and slope adjustment plate defining cooperating fixing means for fixing the slope adjustment plate relative to the head member in two or more different relative orientations.

The use of two spherical surfaces to provide slope compensation, allows for a relatively straightforward adjustment of the slope of the adjustment plate by rotation of the adjustment plate about the centre of curvature of its convex surface.

In a particularly preferred embodiment, the slope adjustment plate defines at least one depending peg and the head member defines an array of holes for receiving the peg and which extend about the centre of the top surface of the head member. In this preferred embodiment, the holes are not equidistant from the centre of the head member but rather are located on a gentle spiral curve to account for relative movement of the adjustment plate on the head member.

Most preferably, a relatively large circular aperture is defined in the centre of the head member and a semi-circular skirt portion depends from the circumference of the aperture. A relatively smaller circular aperture is also defined in the centre of the adjustment plate. A larger diameter circular skirt portion depends down from the convex (underside) of the slope adjustment plate encompassing the aperture and whose centre is offset from the centre of the aperture in the plate. A projecting tab extends outwardly from the base of the circular skirt.

The apertures in the adjustment plate allows an installer of a pedestal floor to adjust the relative orientation of plate and head member by inserting their finger or thumb in the aperture, raising, rotating and lowering the plate. The projecting tab and semi-circular skirt assist in preventing mis-assembly and maladjustment of the head assembly.

In order to provide a pedestal having sufficient strength and load bearing area, it is preferred that both the head member and the slope adjustment plate define further part spherical surfaces which bear against each other in use to distribute loads. In particular the edge area of the head member may define a further part spherical surface which extends in a ring around the perimeter of the head member. The further part-spherical surface is concentric with the centre of curvature of the first concave part-spherical surface but had a larger radius of curvature. Similarly the edge area of the slope adjustment plate defines a part spherical convex surface which extends in a ring around the perimeter of the plate, which is concentric with the centre of curvature of the second convex part-spherical surface but had a larger radius of curvature. This arrangement provides a second load bearing at the outer edges of the plate and head member, in addition to the first and second concave and convex surfaces which share any load carried by the pedestal.

An annular flange and a series of radially extending support ribs may extend between the first concave surface of the head member and the concave outer ring and a series of through holes may be defined in the flange to prevent the build up of water in the head member.

The adjustment plate is typically generally circular in plan view. Preferably, the top of the adjustment plate is marked with a cross passing through the centre of the plate, typically in the form of a relatively shallow groove. At each end of the cross a short arm may be defined which protrudes beyond the circumference of the top surface of the adjustment plate. The arm may define a hole for tying wire, string or the like to the pedestal.

One line/arm of the cross is preferably clearly marked with an arrow and "UP SLOPE" or the like to indicate that, in use, the arrow/arm should point in the upward direction of the slope of the sub floor.

In a preferred embodiment, a series of apertures typically six, are defined in the slope adjustment plate. The apertures may have particular shape, e.g. triangular, and a correspondingly shaped protrusion projects up from the head member and slots through into one of the six apertures. The degree of slope compensation (typically 0% to 5%, in one percent increments) provided by the head assembly is indicated by which aperture the protrusion is located in. The protrusion is most preferably in a contrasting colour to the colour of the slope compensation plate. The numbers zero to five are typically defined on the adjustment plate adjacent the aperture providing that percentage of slope compensation.

To provide a combination of light weight and sufficient strength, the pedestal is typically injection moulded in a plastics material such as polypropylene, however other suitable materials or manufacturing methods could be used.

In a related aspect, the present invention provides a slope adjustable head for an adjustable pedestal adapted to support panel members of an elevated floor structure the head comprising:

a head member; and a slope adjustment plate, wherein the head member defines a first part-spherical, typically concave, surface having a first radius of curvature, and the slope adjustment plate has a first face defining a planar area and an opposite face defining a second part-spherical, typically convex, surface having substantially the same radius of curvature as the first surface, and wherein the part spherical convex surface may be supported on the part spherical concave surface, with relative movement of the convex surface on the concave surface adjusting the angle of the planar portion of the adjustment plate relative to the plane of the base, the head member and slope adjustment plate defining cooperating fixing means for fixing the slope adjustment plate relative to the head member in two or more different relative orientations.

In a yet further aspect the present invention provides an adjustable pedestal adapted to support panel members of an elevated floor structure comprising:

a height adjustable support structure including a base, a head assembly for supporting a panel member or the like, defining a plane on which the support structure stands in use, and at least one spacer element located between the base and the head assembly, wherein the base defines an open top and is internally threaded to receive a lower part of the spacer element, which is externally threaded to engage with the internally threaded portion of the base such that relative rotation of the two adjust the height of the pedestal and characterised by a locking ring which is located on the externally threaded portion of the spacer element which may be rotated to move it into contact with the top of the base or another spacer element if more than one are present, to reduce or prevent relative movement of the base and spacer elements.

The locking elements have the advantage of considerably increasing the stability of the pedestal.

The head assembly may further include a head member; and a slope adjustment plate embodying previously described aspects of the invention.

In order to provide further improvements in stability, in a yet further aspect the present invention provides an adjustable pedestal adapted to support panel members of an elevated floor structure comprising:

a height adjustable support structure including a base, a head assembly for supporting a panel member or the like, defining a plane on which the support structure stands in use, and at least one spacer element located between the base and the head assembly, and wherein the base defines an open top and is internally threaded to receive a lower part of the spacer element, which is externally threaded to engage with the internally threaded portion of the base such that relative rotation of the two adjust the height of the pedestal and characterised by the base and interior of the spacer element being substantially open thereby allowing relatively large materials of a diameter of around 8 mm, typically 10 mm or 20 mm or more to pass unhindered from the top of the spacer element to its bottom and thereby allowing such materials to pass down the pedestal with the head assembly removed, to the base of the pedestal.

The adjustable pedestal may be filled with ballast at least some of which has a diameter of 8 mm or more, or 1 cm or more, or 2 cm or more or larger up to the narrowest part of the internal diameter of the spacer portion which is about 80 mm.

The adjustable pedestal may be filled with concrete to create a concrete pillar enclosed by the pedestal for improved strength and durability.

Throughout this specification the word "comprise", or variations such as "comprises" or "comprising", will be understood to imply the inclusion of a stated element, integer or step, or group of elements, integers or steps, but not the exclusion of any other element, integer or step, or group of elements, integers or steps.

BRIEF DESCRIPTION OF THE DRAWINGS

A specific of the present invention will now be described, by way of example only, and with reference to the accompanying drawings in which.

DETAILED DESCRIPTION OF PREFERRED EMBODIMENTS

Figure 1:
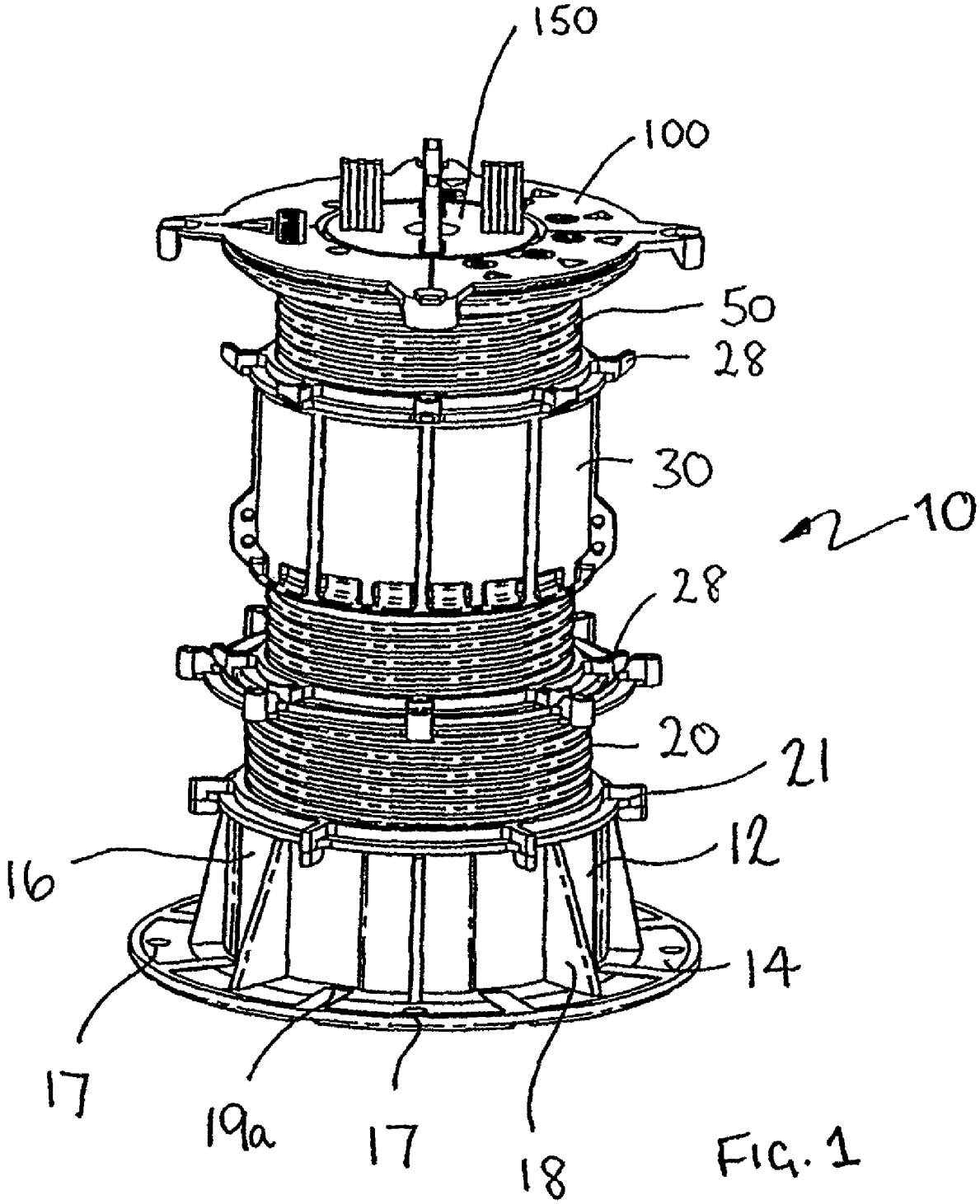
FIG. 1 shows a view of a height adjustable pedestal embodying the present invention.
Figure 2A:
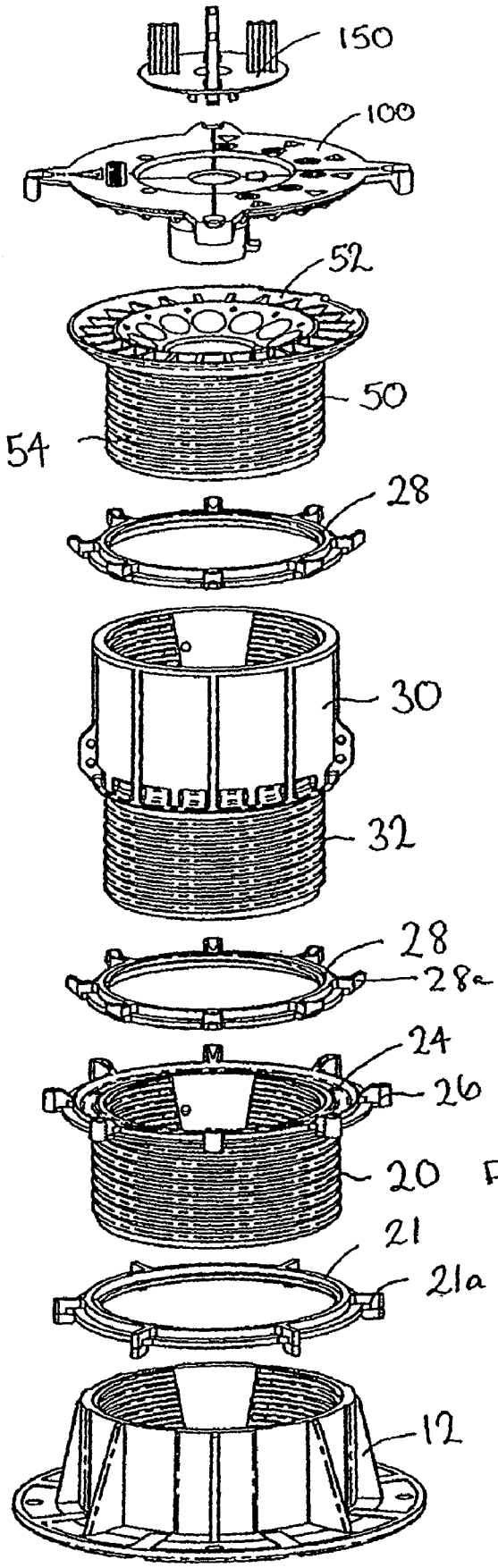
FIG. 2*a* is an exploded view seen from one side and above of the height adjustable pedestal of FIG. 1.
Figure 2B:
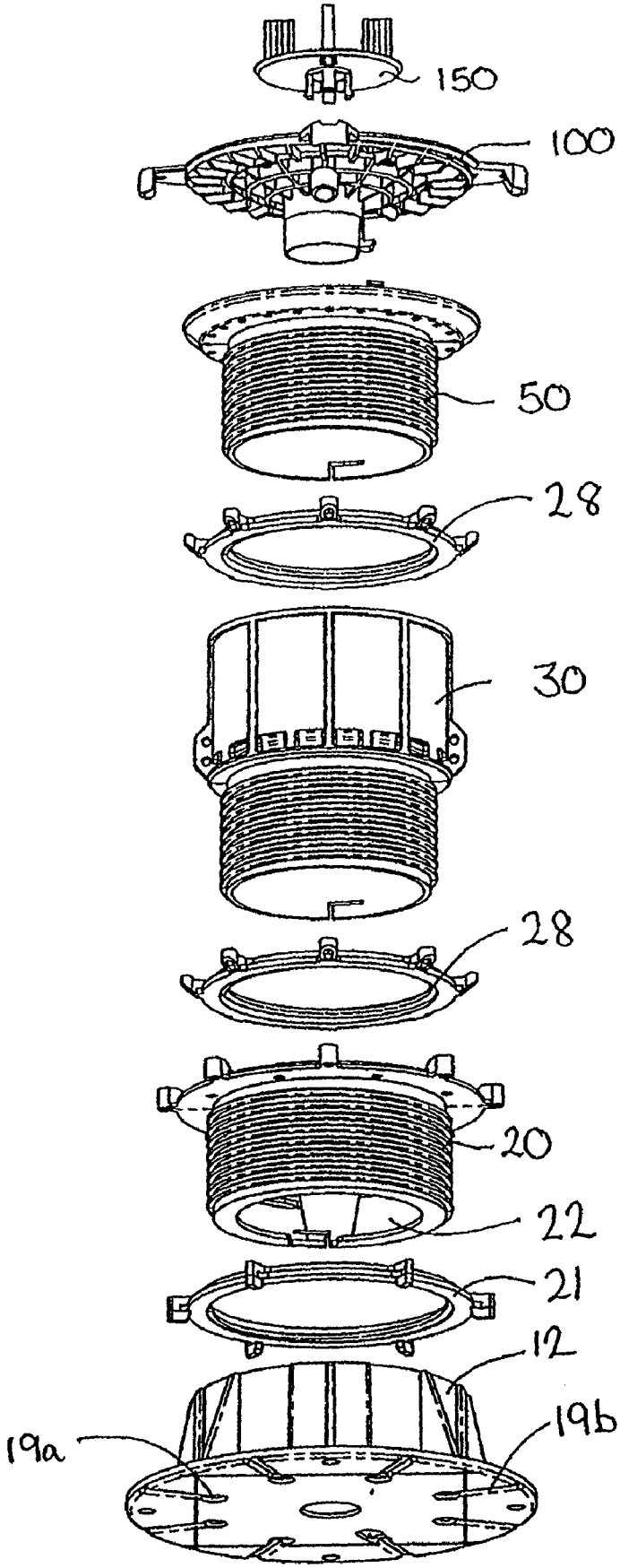
FIG. 2*b* is an exploded view seen from one side and below of the height adjustable pedestal shown in FIG. 1.

Referring to the drawings, FIG. 1 shows a height adjustable pedestal 10 incorporating slope adjustment, embodying the present invention comprising a number of components which can also be seen in the exploded views 2*a* and 2*b*. The height adjustable pedestal comprises a base element 12 comprising a circular planar base plate 14 defining a plane on which the pedestal stand in use, and an annular cylindrical portion 16 extending upwards from the base. The base is rimless to minimise collection of water. A series of holes 17 are defined in the base for bolting, or otherwise fixing, the base to a substrate. The cylindrical portion 16 is internally threaded. A series of generally triangular buttresses/webs 18 extend from the base plate 14 to the outer face of the cylindrical portion 16. Drainage holes 19*a* are also provided for drainage between the vertical webs to prevent build up of water, particularly when the base is inclined. FIG. 2*b* also shows drainage channels 19*b* which extend from the holes 19*a* to the rim so that any water which collects on the underside of the base can run out.

As shown in FIG. 1 an externally threaded cylindrical first spacer element 20 is threadably engaged in the base element. As is best seen in FIGS. 2*a* and 2*b*, the first spacer element has an annular cross section and a generally open base 22. The upper part of the interior of the spacer element is threaded. At the top of the spacer element there is an external flange 24 from which extend a series of projecting lugs 26 which define apertures to enable wire to be threaded therethrough. An annular locking ring 21 is threadably engaged on the external threading of first spacer element 20 and can be rotated to move up and down the threading. The locking ring 21 defines a number of protruding lugs 21*a* which can be grasped to turn the locking ring. When the locking is moved down so that it abuts the top of the base element 12, the contact/interference between the two create stability and prevent wobble of the first spacer element 20 within the base element 12.

A locking ring 28 is provided to prevent unintentional rotation of the first spacer element relative to a further cylindrical spacer element 30 which is threadably engaged in the first spacer element 20. The locking ring defines projecting lugs 28*a* which define holes through which wires or the like may be threaded, if desired. The locking ring may be rotated to move it up or down the external threading of the spacer element 30. When it is moved down so that it abuts the flange 24 of the spacer element 20, the contact/interference between the two create stability and prevent wobble of the spacer element 30 within the spacer element 20.

The further spacer element 30 has a generally annular cross section comprising a lower portion 32 which is externally threaded and configured to locate inside the spacer element 20 and an upper, larger diameter portion 34, which is internally threaded. The base of the spacer element is substantially open.

A further locking ring 28 is disposed between a head portion 50 which will be described in more detail below but includes an upper portion 52 and a depending externally threaded cylindrical portion 54 which is threadably engaged inside the threaded portion 34. A slope compensator plate 100 locates on top of the upper portion of the head portion 50 which again will be described in greater detail below. A cruciform paver separator 150 snap fits into an aperture 110 in the upper portion of the slope adjuster plate.

The pieces together form a telescopic height adjustable jack which can range in height from a minimum of around 60 mm up to approximately 1050 mm. For a pedestal having the lowest possible height the further spacer element 30 is omitted and the head member is threaded directly into the first spacer element 20. Height adjustment is obtained by relative rotation of the head member 50 inside the first spacer element and of the first spacer element 20 inside the base.

When greater height is required the spacer member 30 is used as shown in FIG. 1. Two or more spacer elements 30 could be used where yet further height is required.

In use, a grid of intersecting parallel string lines may be set out on top of a subsurface/sub floor on which a pedestal floor is to be located. The spacing between the string lines will correspond to the width of the floor panel members, such as pavers allowing for any slight gaps between the panel members. A pedestal is placed at each intersection. The height of the pedestals is adjusted to compensate for any slope on the underlying sub floor so that the pedestal floor may be horizontal, if desired. However, it will be appreciated that if the head of the pedestal were perpendicular to the vertical axis of the pedestal, i.e. parallel to the base the pavers will not sit evenly on the pedestals. Accordingly, it is necessary to provide slope compensation as well as height adjustment for the pedestal to account for those circumstances in which the sub-floor is not horizontal but is sloping.

FIGS. 3 to 11 illustrate the features of the slope compensating head assembly of the present invention. As discussed above, the assembly comprises two components, a slope compensation plate 100 shown in FIGS. 3 and 4 and a head member 50 shown in FIG. 5.

Figure 5:
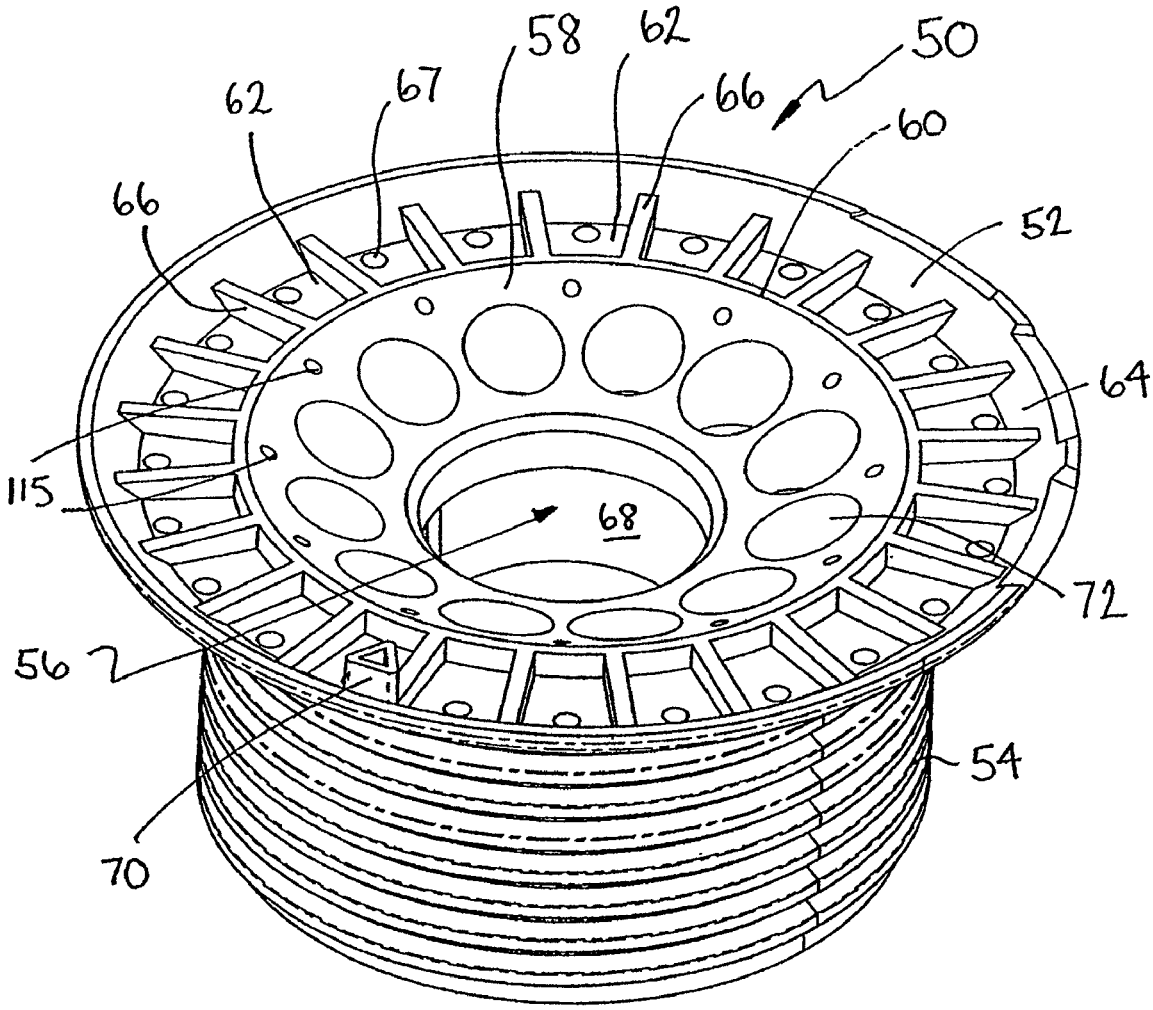
FIG. 5 is a isometric view of the top of a head member of the pedestal shown in FIG. 1.
Figure 6:
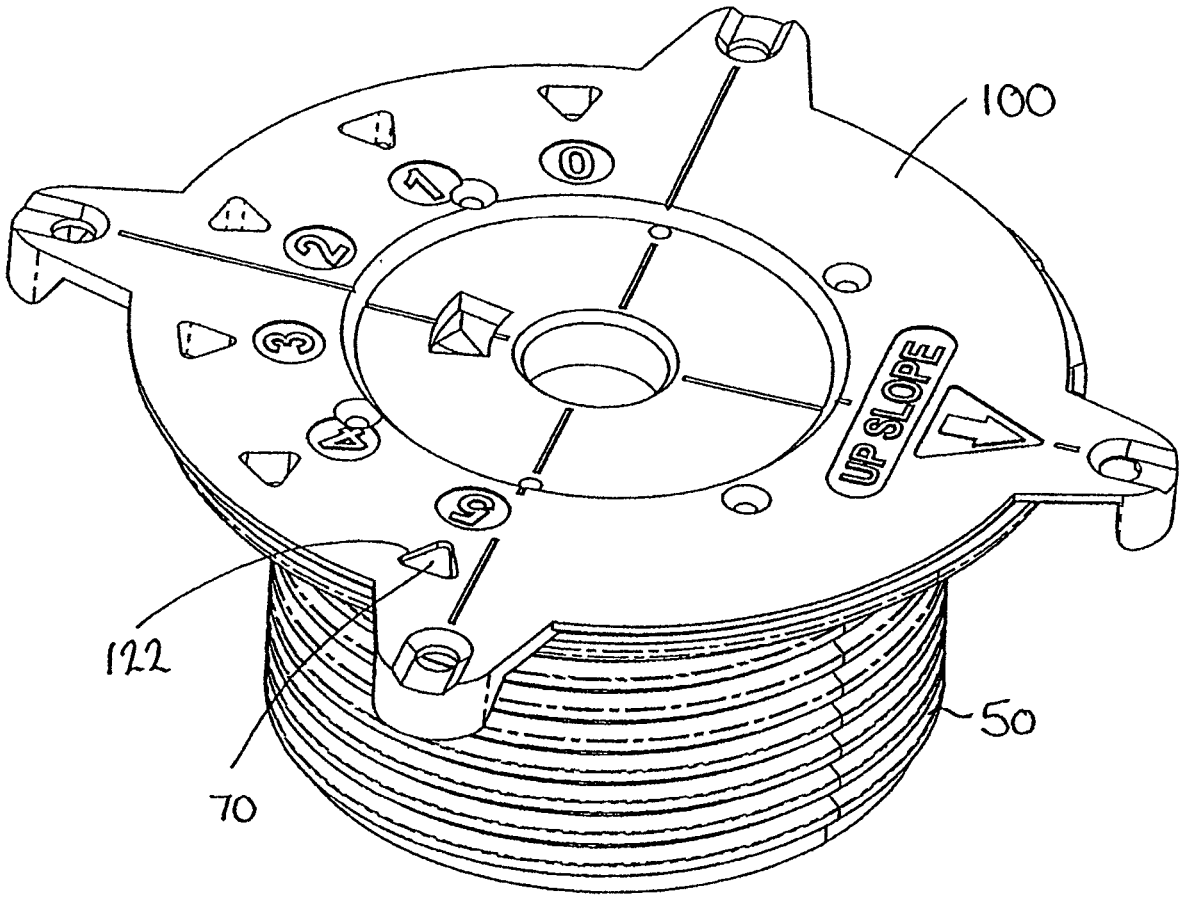
FIG. 6 is an isometric view seen from above of an assembly of the slope compensator plate of FIG. 3 and the head member of FIG. 5.

The head member, best seen in FIG. 5, comprises a head portion 52 from which depends an annular externally threaded cylindrical portion 54. In the centre of the head portion 52 there is a circular aperture 56. Extending around the circular aperture 56 is a first part spherical surface 58 which extends between the perimeter/circumference of the circular aperture 56 and a concentric circle 60. A flange 62 extends from the perimeter of the convex surface to a circular inside perimeter of a further or outer part spherical concave surface 64 in the form of a band which extends in a band/ring around the head member. The flange is recessed slightly relative to the outer edge of the first part spherical surface 58. A series of radially aligned strengthening ribs 66 extend across the flange from the perimeter/circumference of the circular aperture 56 to the further part spherical surface 64. A series of drainage holes 67 are formed in the flange between adjacent pairs of ribs to prevent build up of water.

A semi-circular skirt portion 68 (also seen in FIG. 9) depends from the circumference of the aperture 56.

A post 70 having a generally triangular cross-section extends up from the head member approximately where the flange and outer part spherical surface meet.

A series of twelve generally circular holes 72 extend through the first part spherical surface 58. In use the apertures may receive one of two diametrically opposed pegs which depend from the slope adjuster plate described in more detail below. Although the circular holes are superficially similar in appearance, in fact the axes of the circular holes are slightly different and apart from a 0% compensation pair of opposed circular holes are offset relative to the vertical axis of the pedestal, to compensate for the different orientations of the slope adjuster plate on the head member. There are two pegs and the apertures are located so that diametrically opposed pairs are aligned at the same angle. Also the centre of the circular holes are not arranged equidistantly from the centre of the head member but are arranged on two part spiral curves each extending through 180°, to account for the differences in position of the slope adjuster plate on the head member. The holes corresponding to a particular percentage compensation is further from the centre of the aperture 56, than the holes corresponding to a lesser degree of slope compensation.

Figure 3:
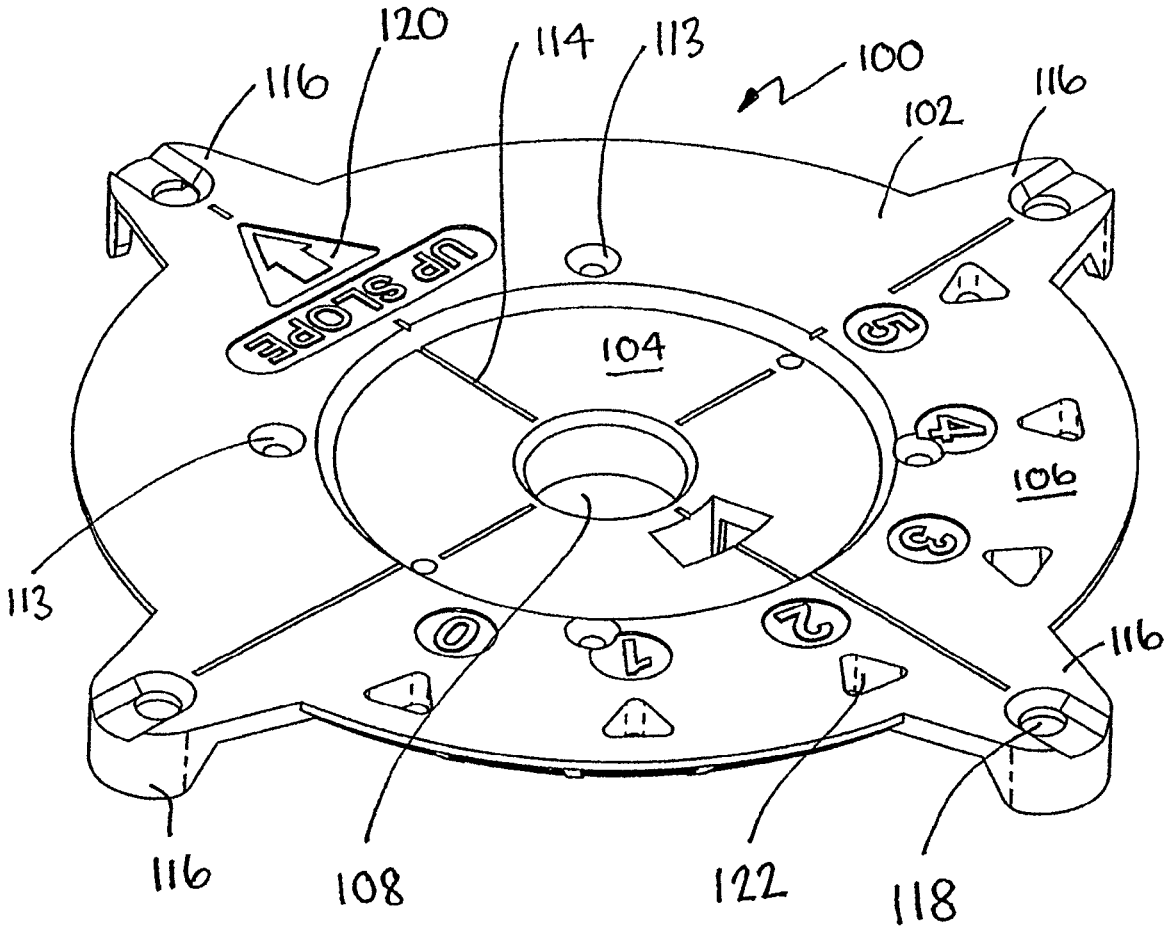
FIG. 3 is a isometric view of the top of a slope adjustment plate of the height adjustable pedestal.
Figure 4:
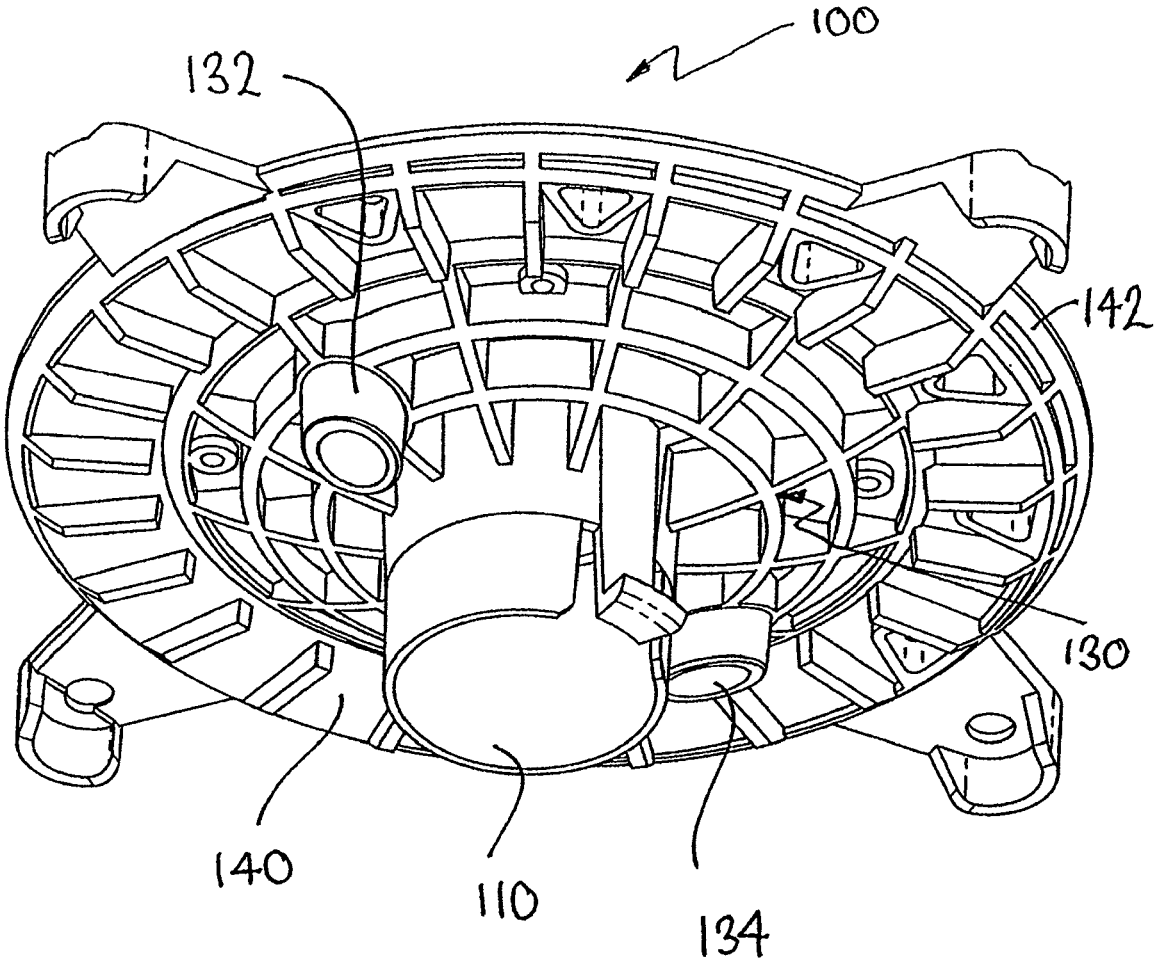
FIG. 4 is an isometric view of the underside of slope adjustment plate of FIG. 3.
Figure 9:
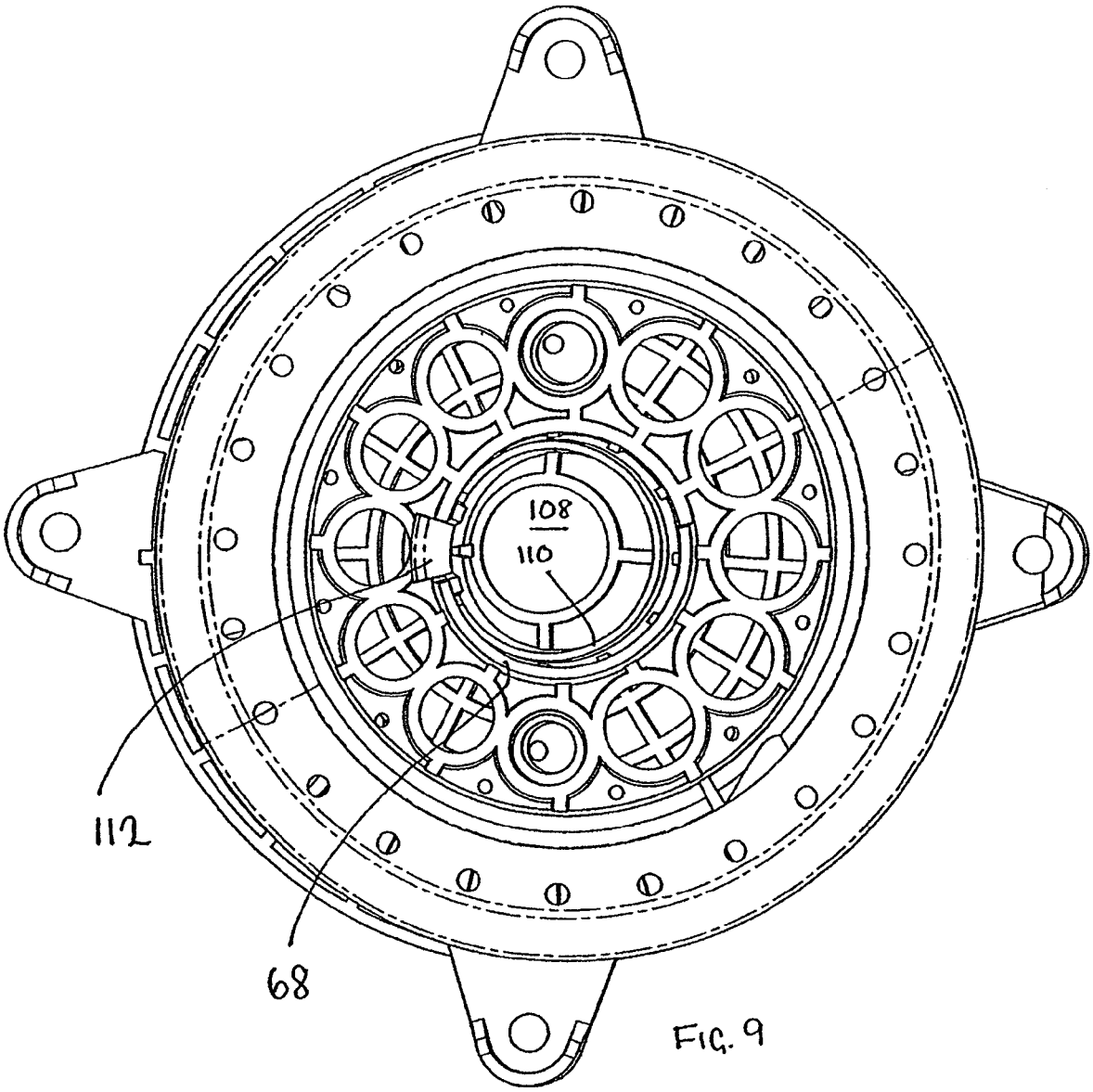
FIG. 9 is an underneath plan view of the assembly shown in FIGS. 6 to 8.

The slope adjuster plate is best shown in FIGS. 3 and 4. It is generally circular in plan view. The top surface 102 includes a central circular portion 104 which is recessed relative to an outer ring 106. A circular aperture 108 is defined in the centre of the adjustment plate. As is best seen in FIG. 4, a larger diameter circular skirt portion 110 depends down from the convex underside of the slope adjustment plate encompassing the aperture. As is best seen in FIG. 9, the centre of the skirt portion is offset from the centre of the aperture in the plate. A tab 112 projects radially outwardly from the base of the circular skirt.

In order to fix the slope compensation plate relative to the head 50 and prevent accidental dislodgement of the same due to wind, an impact or the like, screw holes 113 are provided in the top of the plate through which "tek" screws or the like may pass into receiving/pilot holes 115 in the head 50 (see FIG. 5). Alternatively the screws may simply be screwed into the head portion 52.

The top surface of the adjustment plate is marked with a cross 114 passing through the centre of the plate and defined by intersecting relatively shallow grooves. At each end of the cross a short arm 116 is defined which protrudes beyond the circumference of the top surface of the adjustment plate and defines a hole 118 for tying wire, string or the like to the pedestal. The arms can also be used to lift the adjustment plate for adjusting the degree of slope compensation.

One arm of the cross is marked with an arrow 120 and "UP SLOPE". In use, the arrow/arm should point in the upward direction of the slope of the sub floor.

A series of six spaced apertures 122 are defined in the top surface of the slope adjustment plate. The apertures are triangular, and are shaped to receive the triangular post 70 which projects up from the head member 50 and slots into one of the six apertures depending on the relative orientation of the plate 100 and head member 50. In the described embodiment the degree of slope compensation is from 0% to 5%, in one percent increments and the apertures are numbered 0 to 5 to indicate the selected degree of slope compensation. The post 70 is most preferably in a contrasting colour to the colour of the slope compensation plate.

The underside of the slope compensation plate defines a convex part spherical surface 130 extending in a band outside the skirt 110. The surface is not continuous but is defined by the lower edges of an array of intersecting circular rings and radial ribs. This allows for drainage and for simpler manufacture. A flange 140 extends from the outer edge of the convex surface to a further part spherical convex surface 142 defined at the outer edge of the underside of the plate 100. The centre of curvature of the further convex surface is the same at that of the convex surface, although its radius of curvature in greater.

Two diametrically opposed cylindrical pegs 132 and 134 depend down from the convex surface spaced, one peg 134 being relatively wider than the other 132.

Figure 10:
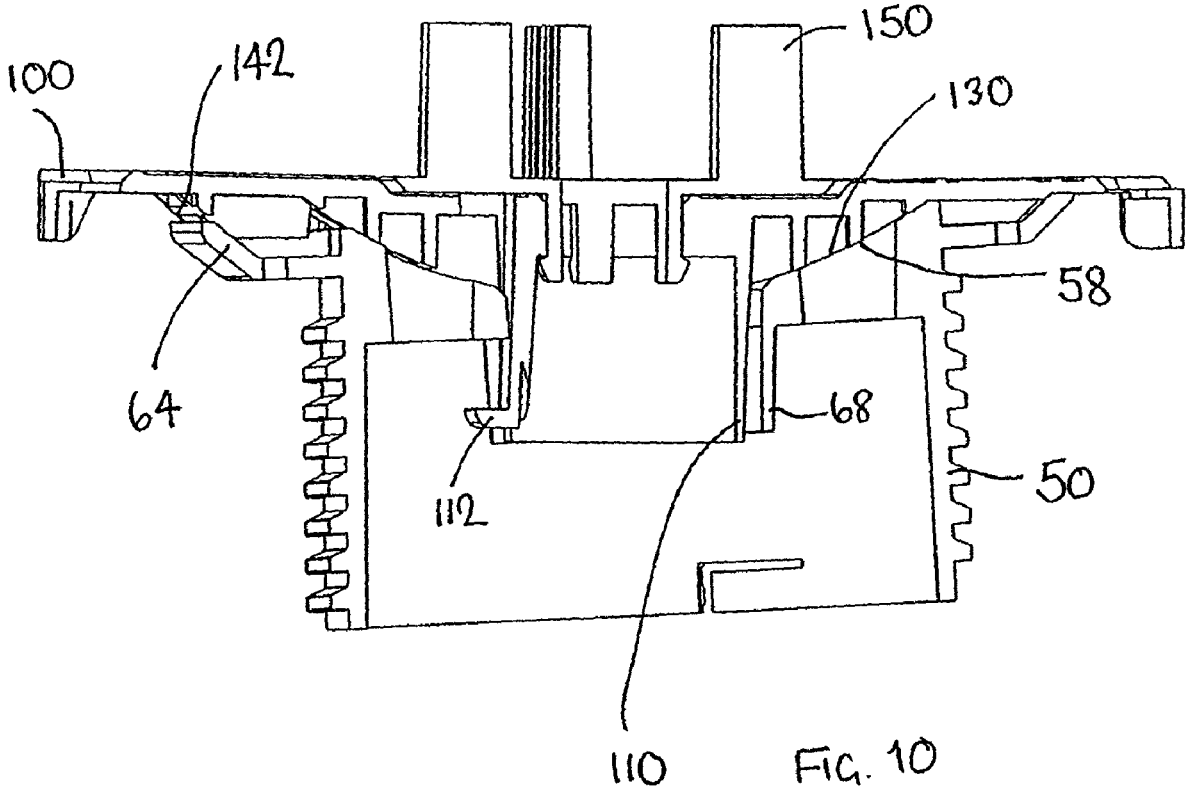
FIG. 10 is a cross section through the assembly also showing a paver spacer.
Figure 11:
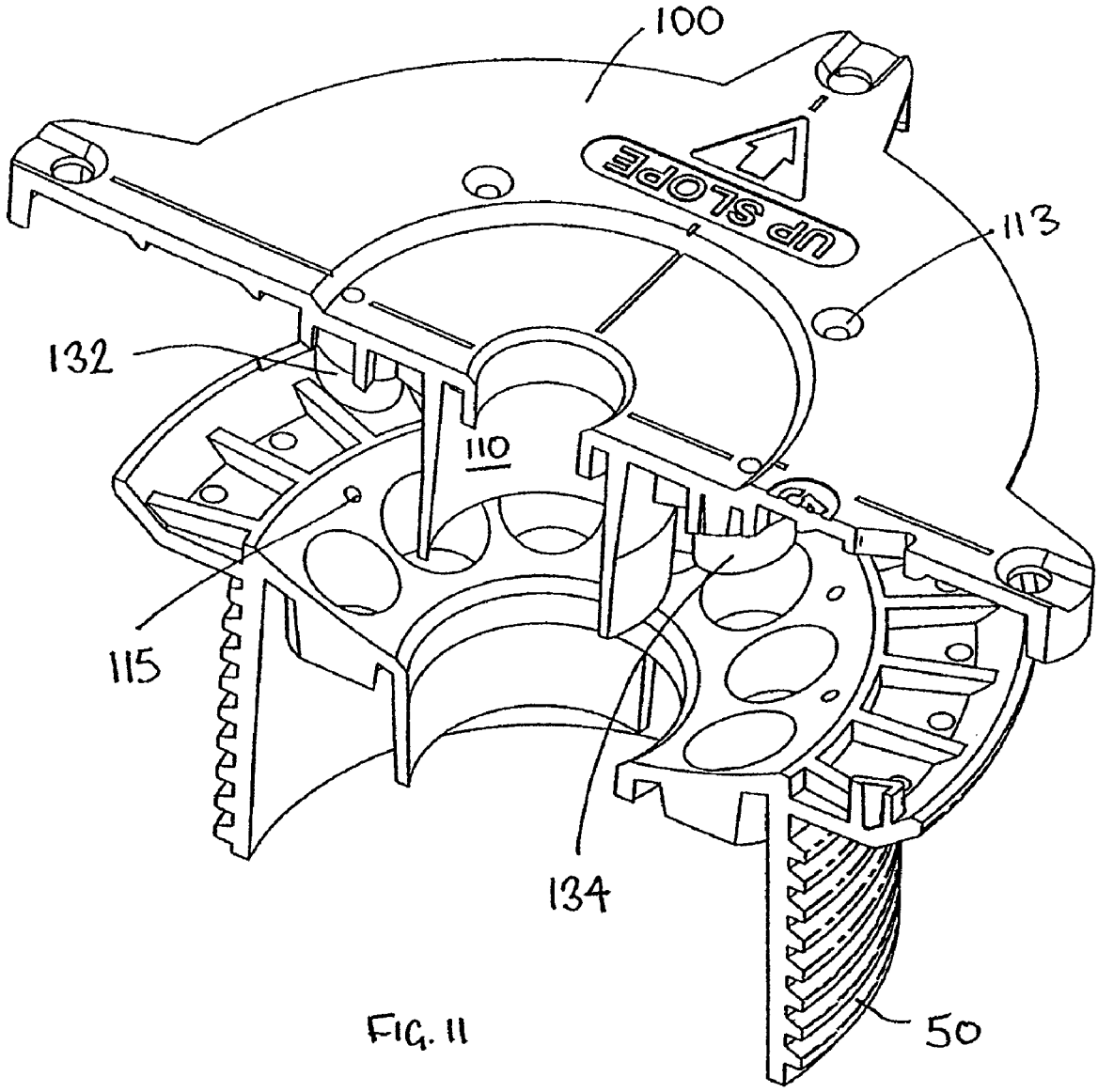
FIG. 11 is an exploded isometric sectional view of the slope adjustment plate and head member of FIG. 10.

FIGS. 6 to 11 show the assembled head assembly and illustrate its use. With reference to FIGS. 10 and 11 in particular, the depending skirt 110 of the slope compensator plate 100, passes through the aperture 56 in the centre of the head member. The tab 112 and the semicircular skirt ensure that the device can only be assembled in the correct orientation allowing for 180° rotation of the slope compensator relative to the head member, as the tab 112 moves in a semicircular path between the ends of the skirt 68. When the tab reaches the skirt, further rotation is prevented by the tab 112 abutting the skirt 110. This is best seen in FIG. 9.

Figure 7:
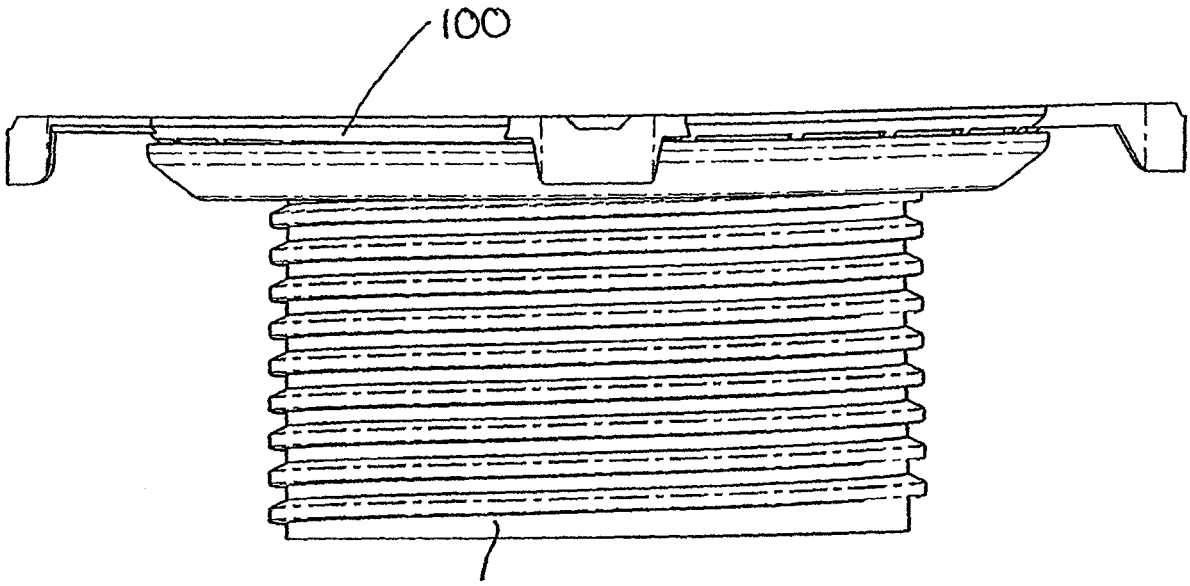
FIG. 7 is a side view of the assembly of FIG. 6 showing 0% compensation.
Figure 8:
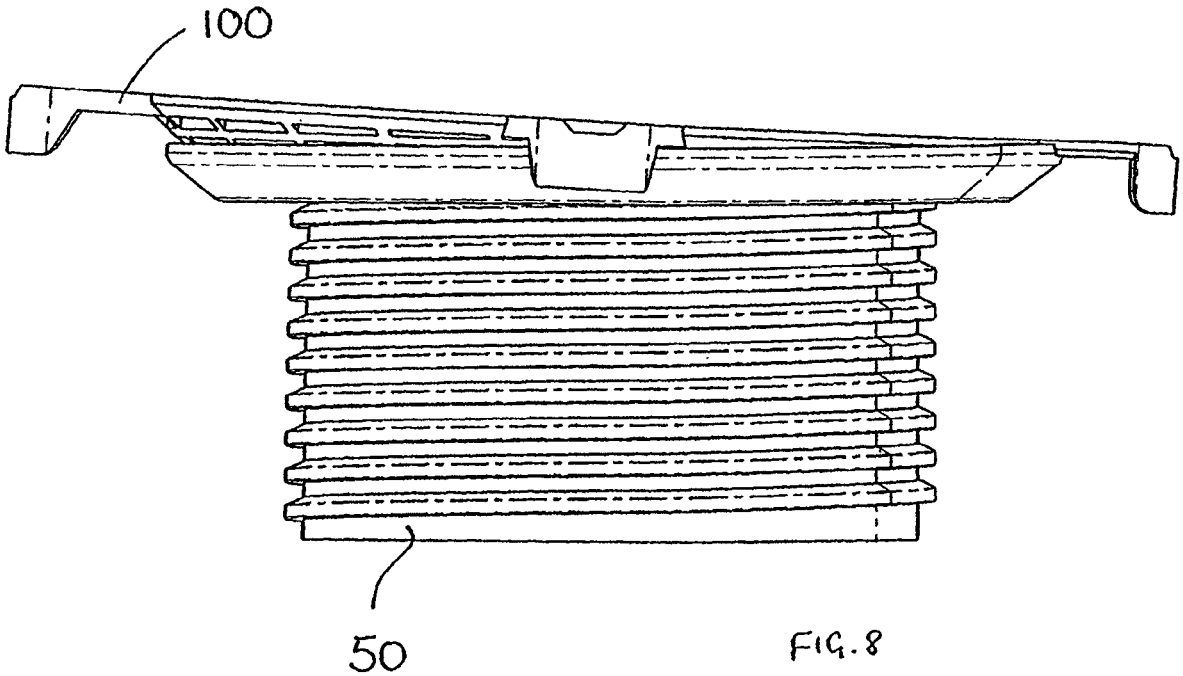
FIG. 8 is a side view of the assembly of FIG. 6 showing 5% slope compensation.

In the described embodiment the head assembly may be positioned in six different orientations corresponding to the degree of slope compensation from 0% (FIG. 7) to 5% (FIG. 8), in one percent increments. The degree of slope compensation is determined by which pair of opposed holes 70 the depending pegs 132 and 134 are inserted in. As discussed above, the angle of the central axis of each pair of opposed holes relative to the vertical axis of the pedestal is slightly divergent from the axis to provide the required degree of slope compensation. One peg being wider than the other also helps prevent mis-assembly. The triangular apertures 122 indicate which degree of slope compensation is being provided as the protrusion 70 appears in the relevant aperture. FIG. 7 illustrates 0% slope compensation. FIG. 8 illustrates 5% slope compensation. To adjust the degree of slope compensation an operator inserts their finger or thumb in the aperture 108 in the plate, or lifts the short arms 116, with the tab preventing accidental removal, and simply rotates the plate until the protrusion is located below the relevant aperture 122 indicating the desired degree of slope compensation, and lowers the plate at which time the pegs 132, 134 should slot into the correct pair of holes 70. Advantageously, whatever degree of slope compensation is provided, the UP SLOPE arrow 120 is always pointed in the counter direction of the slope.

Numerous variations to the described embodiment are possible. For example although 0 to 5% slope compensation is provided in the described example, it will be appreciated that it would be possible to create say 0 to 6% compensation, in which case 14 holes will be provided in the central concave area of the head member, or greater degrees of compensation such as 0 to 10% or more.

Although the pedestal as described above is particularly suited to use on sloping sub floors and subsurfaces to create a level pedestal floor, it will be appreciated that it may also be used to create a level raised floor on a level/horizontal sub floor, in which case the slope adjustment plate is set to 0% slope compensation. Alternatively it could also be used to create a sloping pedestal floor on top of a horizontal sub floor/subsurface.

Figure 12:
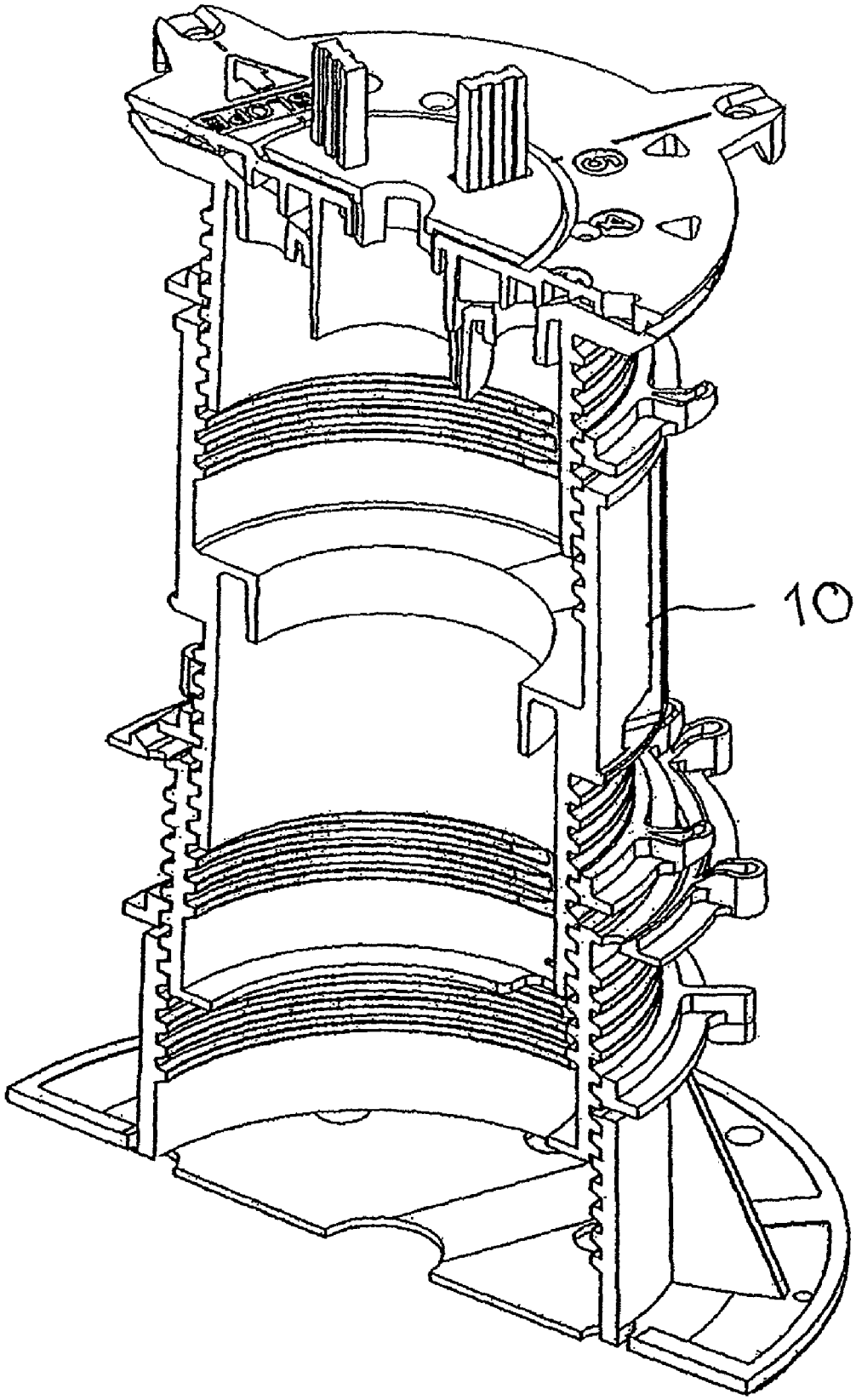
FIG. 12 is a section through a pedestal embodying the invention.
Figure 12A:
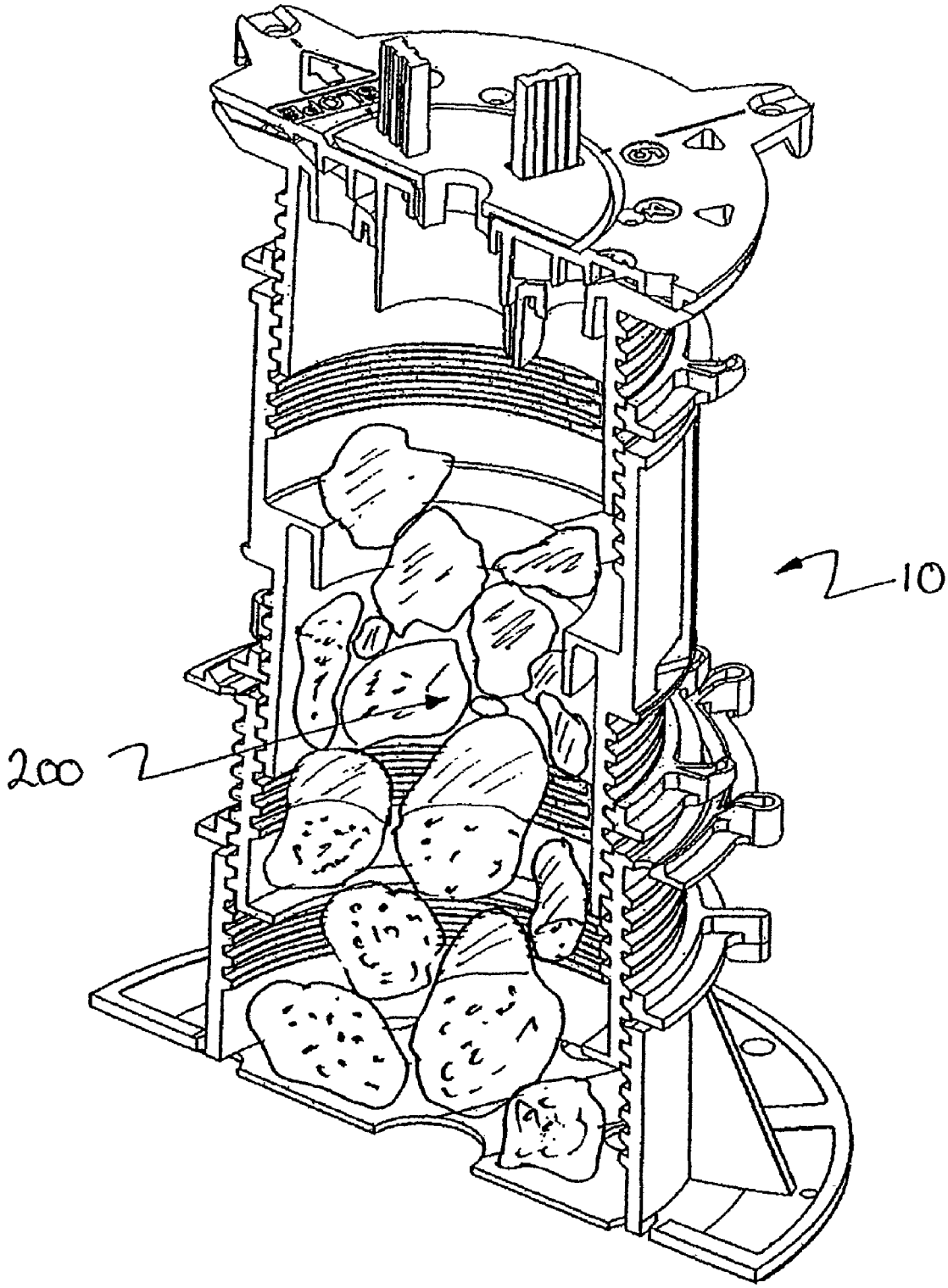
FIG. 12*a* shows the sectioned pedestal containing ballast.
Figure 12B:
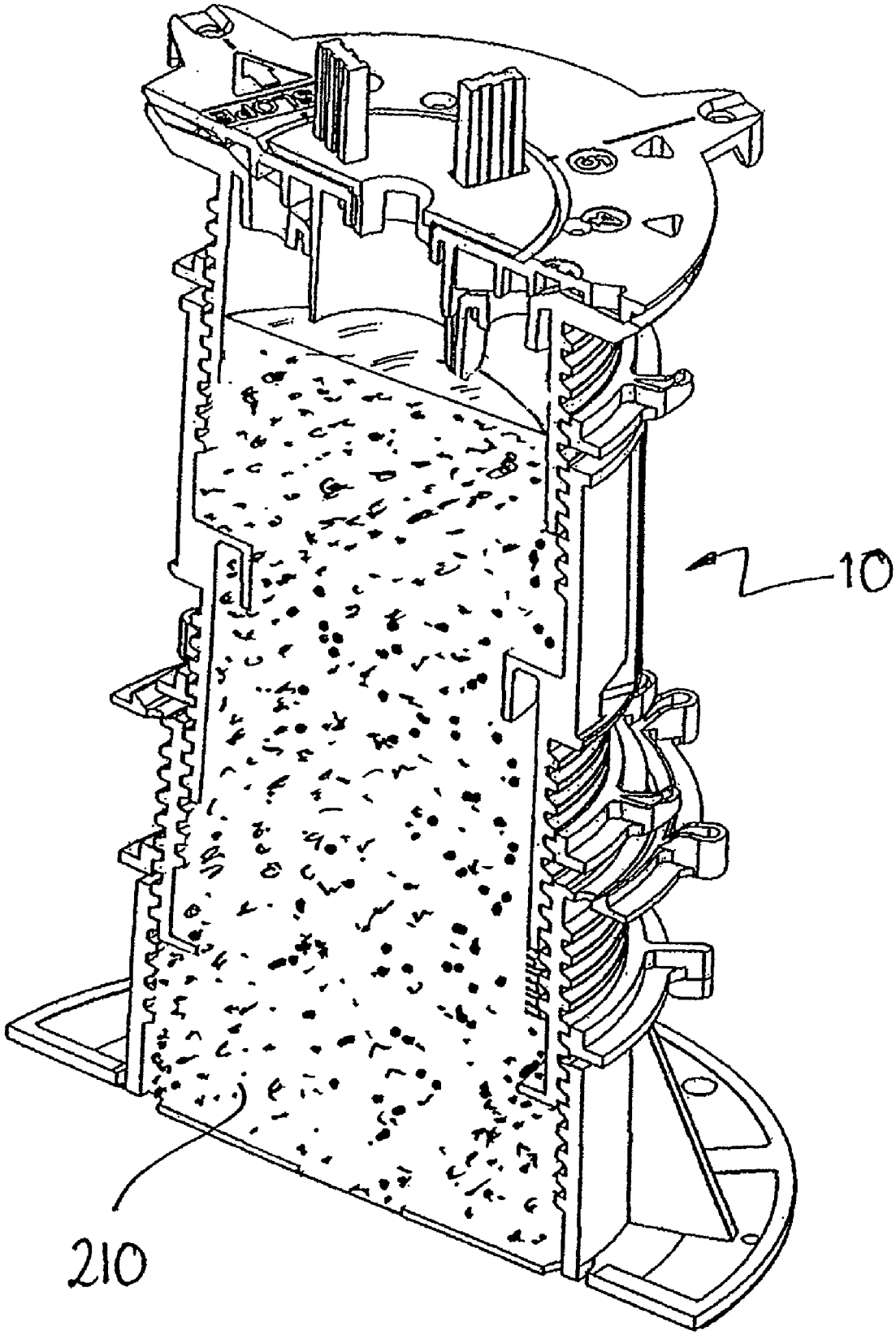
FIG. 12*b* shows the sectioned pedestal containing concrete.

FIG. 12 shows a section through the adjustable pedestal. With reference to that figure, it can be seen that if the slope compensator plate 100 and optionally also the head portion 50 are removed the pedestal is substantially hollow with a substantially free path for material to pass into the pedestal from its open top to the base 14. This is made possible in part by the fact that the interior of the spacer portion is open and at its narrowest in still about 80 mm diameter. This allows the filling of the pedestal with ballast such as gravel, hard core rocks or other suitable materials. This is particularly advantageous where there is a need to increase the weight of the pedestals, for example where they are or may be immersed in water. It also allows for the possibility of filling the pedestal with concrete to increase the strength weight and durability of the pedestal. FIG. 12*a* shows the pedestal containing ballast in the form of rocks 200. A concrete 210 filled pedestal 10 is shown in FIG. 12*b*.

Figure 13:
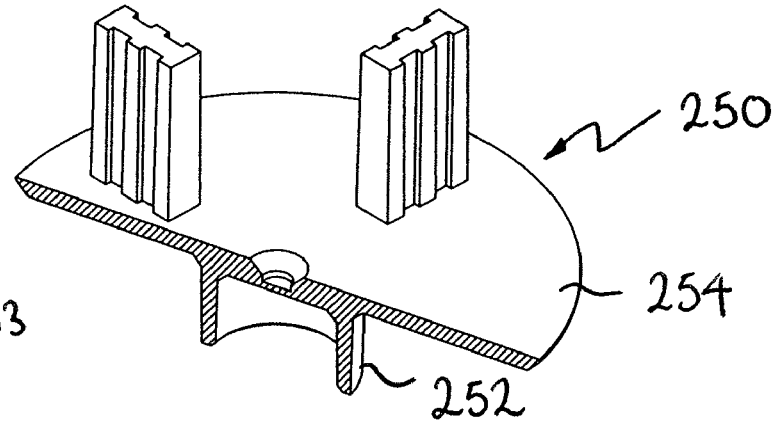
FIG. 13 shows a cross-section through a variant of a paver separator.

FIG. 13 shows a variant 250 of the cruciform paver separator 150. The only difference present in the variant 250 compared to paver separator 150 is in the form of the spigot 252 which depends from the paver separator 250. Instead of the four depending legs of paver separator 150, the depending spigot 252 of separator 250 is annular having a circular cross-section in a plane parallel to the plate 254 of the separator.

Figure 14:
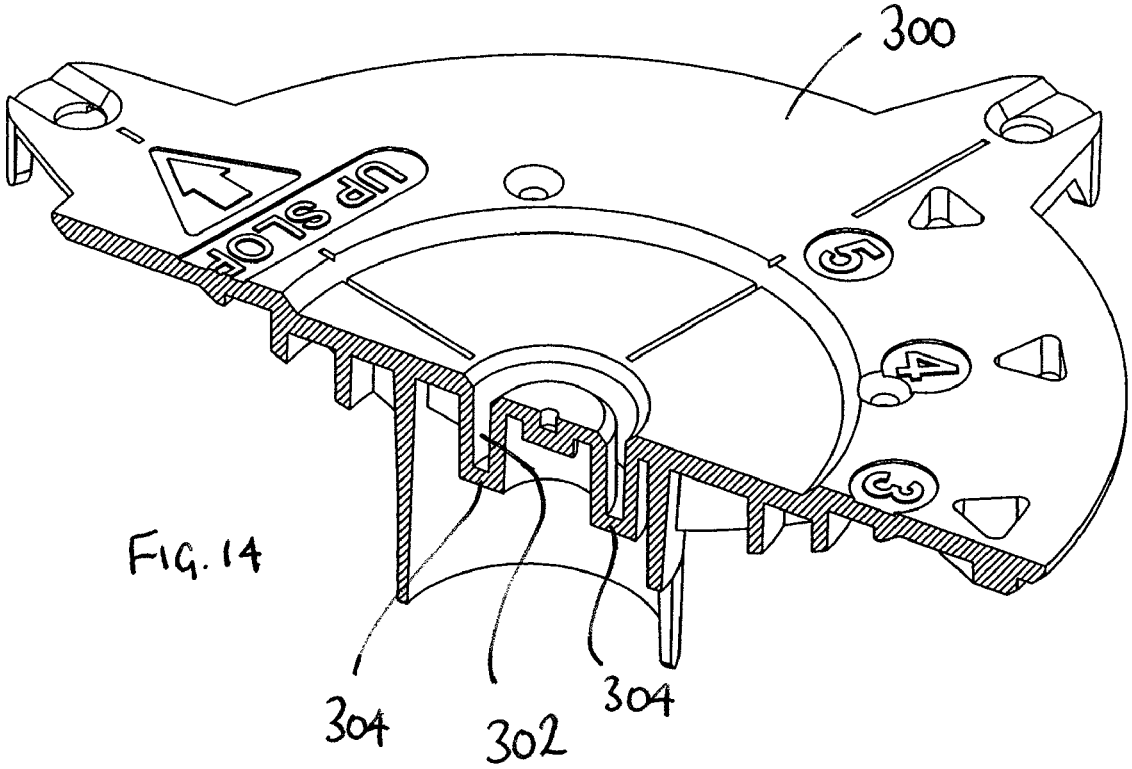
FIG. 14 shows a cross-section through a variant of a slope adjuster plate.

FIG. 14 shows a slope compensator plate 300 which is a variant of the slope compensator plate 100 shown in FIGS. 3 and 4. The slope compensator plate 300 is identical to the compensator plate 100, except that instead of having a through hole for receiving the depending legs of the separator, it defines an annular channel 302 having a circular cross-section for receiving the depending spigot 252 of the paver separator. The channel has a base 304 so that it is closed and any water that may pass into the channel 302 cannot pass into the pedestal below. The channel 302 is substantially the same size, shape and depth as the depending spigot 252 so that the spigot is a tight fit within the channel.

It will be appreciated by persons skilled in the art that numerous variations and/or modifications may be made to the invention as shown in the specific embodiments without departing from the spirit or scope of the invention as broadly described. The present embodiments are, therefore, to be considered in all respects as illustrative and not restrictive.

The invention claimed is:

1. An adjustable pedestal adapted to support panel members of an elevated floor structure comprising:

a height adjustable support structure including a base and a head assembly, the base defining a plane on which the support structure stands in use, said head assembly including:

a head member; and a slope adjustment plate, wherein the head member defines a first part-spherical, surface having a first radius of curvature, and the slope adjustment plate has a first face defining a planar area and an opposite face defining a second part-spherical, surface having substantially the same radius of curvature as the first surface, and wherein the second part spherical surface may be supported on the first part spherical surface, with relative movement of the second part-spherical surface on the first part-spherical surface adjusting the angle of the planar portion of the adjustment plate relative to the plane of the base, wherein the slope adjustment plate defines at least one depending peg and the head member defines an array of holes for receiving the peg and which extend about the center of the top surface of the head member for fixing the slope adjustment plate relative to the head member in two or more different relative orientations.

2. An adjustable pedestal as claimed in claim 1 wherein adjustment of the slope of the adjustment plate is by rotation of the adjustment plate about the centre of curvature of the second part-spherical surface.

3. An adjustable pedestal as claimed in claim 1 wherein the array of holes are located on a spiral curve.

4. An adjustable pedestal as claimed in claim 1 wherein a circular aperture is defined in the centre of the head member and a part-circular skirt portion depends from the circumference of that aperture.

5. An adjustable pedestal as claimed in claim 4 wherein a circular aperture which is relatively smaller than the circular aperture in the centre of the head member is also defined in the centre of the adjustment plate and wherein a circular skirt portion depends down from the underside of the slope adjustment plate encompassing the aperture and wherein the centre of the skirt portion is offset from the centre of the aperture in the plate.

6. An adjustable pedestal as claimed in claim 5 wherein a projecting tab extends outwardly from the base of the circular skirt portion of the head member.

7. An adjustable pedestal as claimed in claim 4 wherein a circular channel which is relatively smaller in diameter than the circular aperture in the centre of the head member is defined in the centre of the adjustment plate.

8. An adjustable pedestal as claimed in claim 1 wherein a further part spherical surface extends in a ring around the perimeter of the head member which is concentric with the centre of curvature of the first part-spherical surface but has a larger radius of curvature and defines a concave outer ring.

9. An adjustable pedestal as claimed in claim 8 wherein the slope adjustment plate defines a part spherical convex surface which extends in a ring around the perimeter of the plate, which is concentric with the centre of curvature of the second part-spherical surface but had a larger radius of curvature.

10. An adjustable pedestal as claimed in claim 9 wherein an annular flange and a series of radially extending support ribs extend between the first part-spherical surface of the head member and the concave outer ring and a series of through holes are be defined in the flange to prevent the build up of water in the head member.

11. An adjustable pedestal as claimed in claim 1 wherein the adjustment plate is generally circular in plan view.

12. An adjustable pedestal as claimed in claim 11 wherein the top of the adjustment plate is marked with a cross passing through the centre of the plate, and at each end of the cross an arm is defined which protrudes beyond the circumference of the top surface of the adjustment plate which defines a hole for tying wire, string or the like to the pedestal.

13. An adjustable pedestal as claimed in claim 12 wherein one arm of the cross is marked with an arrow which, in use, should point in the direction of the slope of the floor on which the pedestal sits.

14. An adjustable pedestal as claimed in claim 1 wherein a series of apertures having a particular shape are defined in the slope adjustment plate and a correspondingly shaped protrusion projects up from the head member and slots through into one of the apertures and wherein the degree of slope compensation provided by the head assembly is indicated by which aperture the protrusion is located in.

15. An adjustable pedestal adapted to support panel members of an elevated floor structure as claimed in claim 1, and further comprising:

at least one spacer element located between the base and the head assembly, and wherein the base defines an open top and is internally threaded to receive a lower part of the spacer element, which is externally threaded to engage with the internally threaded portion of the base such that relative rotation of the two adjust the height of the pedestal and characterized by a locking ring which is located on the externally threaded portion of the spacer element which may be rotated to move it into contact with the top of the base or another spacer element if more than one are present, to reduce or prevent relative movement of the base and spacer elements.

16. An adjustable pedestal as claimed in claim 1 wherein the first part-spherical surface is concave and the second part-spherical surface is convex.

17. A slope adjustable head for an adjustable pedestal adapted to support panel members of an elevated floor structure the head comprising:

a head member; and a slope adjustment plate, wherein the head member defines a first part-spherical, concave, surface having a first radius of curvature, and the slope adjustment plate has a first face defining a planar area and an opposite face defining a second part-spherical, convex surface having substantially the same radius of curvature as the first surface, and wherein the part spherical convex surface may be supported on the part spherical concave surface, with relative movement of the convex surface on the concave surface adjusting the angle of the planar portion of the adjustment plate relative to the plane of the base, the head member and slope adjustment plate defining co-operating pegs and an array of co-operating holes for receiving the pegs which extend in a curve for fixing the slope adjustment plate relative to the head member in two or more different relative orientations.

18. A slope adjustable head as claimed in claim 17 wherein adjustment of the slope of the adjustment plate is by rotation of the adjustment plate about the centre of curvature of its convex surface.

19. A slope adjustable head as claimed in claim 17 wherein the slope adjustment plate defines two depending pegs, one of the two pegs being wider than the other.

20. A slope adjustable head as claimed in claim 19 wherein the array of holes are located on a spiral curve.

* * * * *